United States Patent [19]

Swart

[11] 4,304,006

[45] Dec. 8, 1981

[54] COVERALL GARMENT FOR TODDLERS

[76] Inventor: Klara Swart, 8169 Leigh Ann, Dallas, Tex. 75232

[21] Appl. No.: 111,538

[22] Filed: Jan. 14, 1980

[51] Int. Cl.[3] ..... A41D 11/00; A41B 13/10

[52] U.S. Cl. ..... 2/49 R; 2/79; 2/80

[58] Field of Search ..... 2/80, 79, 49 R, 51, 2/69, 69.5

[56] References Cited

U.S. PATENT DOCUMENTS

| | | | |
|---|---|---|---|
| 717,854 | 1/1903 | Holston | 2/51 |
| 2,442,192 | 5/1948 | Bookbinder | 2/69.5 |
| 2,469,700 | 5/1949 | Petrucelli | 2/69.5 |
| 2,521,609 | 9/1950 | Segerman | 2/69.5 |
| 2,657,387 | 11/1953 | Ketcham | 2/69.5 |
| 2,675,552 | 4/1954 | Jackson | 2/69.5 |
| 3,093,132 | 6/1963 | Bailey | 2/69.5 |
| 3,477,065 | 11/1969 | Hoover | 2/69.5 |
| 3,523,302 | 8/1970 | Rabedeaux | 2/69.5 |
| 3,772,705 | 11/1973 | Angel et al. | 2/79 |
| 4,117,552 | 10/1978 | Simpson | 2/79 X |

FOREIGN PATENT DOCUMENTS

| | | | |
|---|---|---|---|
| 1083235 | 9/1967 | United Kingdom | 2/80 |

*Primary Examiner*—H. Hampton Hunter
*Attorney, Agent, or Firm*—Dennis T. Griggs

[57] ABSTRACT

A one-piece disposable coverall garment for use by toddlers during mealtime is disclosed. The one-piece coverall garment includes loosely fitting blouse and trousers sections which are padded with an absorbent material to prevent exposure of the toddler's clothing to spilled food and drink. The blouse section is characterized by an oval neck opening and a deep back opening along the middle of the back to the waist. The neck and back openings have a common border section formed by a drawstring fastener. The neck and back openings are opened and closed simultaneously by the drawstring fastener, and when the drawstring fastener is untied, the blouse portions forming the border of the neck and back openings can be widely separated thereby defining, in combination, a large, step-in opening.

1 Claim, 4 Drawing Figures

COVERALL GARMENT FOR TODDLERS

BACKGROUND OF THE INVENTION

1. Field of the Invention

The present invention relates to clothing accessories for children, and in particular to a disposable coverall garment for toddlers.

2. Description of the Prior Art

Small children, sometimes referred to as toddlers, begin to develop manual dexterity and eye coordination during the formative years of 18 months to three years. During this learning experience, toddlers prefer to use their hands and fingers as a substitute for spoons and forks at mealtimes with the predictable results that their clothing usually becomes soiled with spilled food and drink. It is generally believed that handling and manipulating food is an important part of a child's development as a transition from being spood fed by its parents to eating correctly with silverware and without accidents. It is further believed that the tactile learning experience provided by handling of the food by a toddler in a relaxed atmosphere will, in the long run, lead to the development of good eating habits, even though this process is sometimes frustrating to the parents.

In order to minimize the clean-up problems associated with the handling of food by toddlers, a bib or cloth is worn by the toddler while eating, to protect his clothing. The bib typically comprises a single thickness of cloth or plastic which is placed on the toddler's chest directly beneath his chin. The bib arragement eliminates a substantial part of the clean-up problems involved with food which is inadvertently dropped or spilled. Because of this protection, the parents are at ease, and the toddler senses this and is therefore more relaxed and receptive to training directions and suggestions.

Although the conventional bib has been successful and extremely useful, it protects only a relatively small area of a toddler's clothing which might be exposed to food which has been spilled or dropped. Additionally, it is not unusual for toddlers to wipe their hands on anything within reach, including especially their own clothing. The conventional bib cannot provide protection for this situation.

SUMMARY OF OBJECTS OF THE INVENTION

It is, therefore, the principal object of the present invention to provide a coverall garment for use by toddlers during mealtime which offers substantially complete protection against spilled food and drink.

A related object of the invention is to provide a one-piece, loosely fitting, disposable coverall garment which can be quickly and easily put on and removed from a toddler, with only minimum asistance by parents.

SUMMARY OF THE INVENTION

The foregoing objects of the invention are realized by a one-piece coverall garment made of a fibrous, absorbent material, which is padded with a layer of absorbent materials in strategic areas which are likely to be exposed to spilled food or drink, or which can be touched by the toddler. The one-piece covering comprises a coverall garment having a lower trousers section and an upper blouse section which are integrally formed as a one-piece coverall garment. The blouse and trousers are loosely fitting and are padded in strategic areas with a layer of an absorbent paper material, preferably of the type typically used in the construction of disposable diapers. The blouse includes sleeves and shoulder sections which are also padded with the absorbent material, and includes an oval neck opening and a deep back opening which are joined along a common border by a drawstring fastener. When the drawstring fastener is released, the combined neck and back openings produce a large step-in opening by means of which the toddler can be quickly dressed for mealtime, and which also facilitates removal after mealtime.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DETAILED DESCRIPTION OF THE PREFERRED EMBODIMENT

Figure 1:
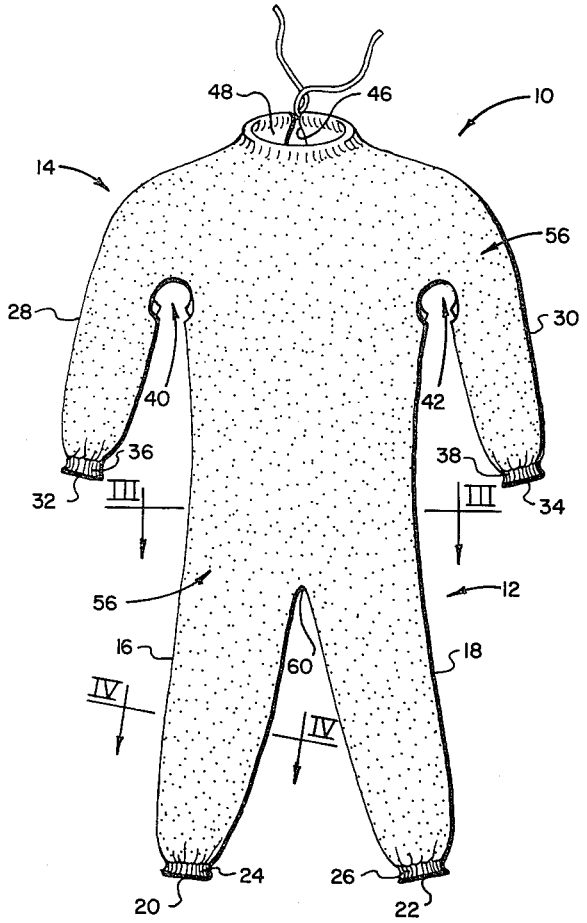
FIG. 1 is a front elevation view of a coverall garment constructed according to the teachings of the invention.

In the description which follows, like parts are marked throughout the specification and drawing with the same reference numerals, respectively. The drawing figures are not necessarily to scale and in some instances portions have been exaggerated in order to more clearly depict certain features of the invention.

Figure 2:
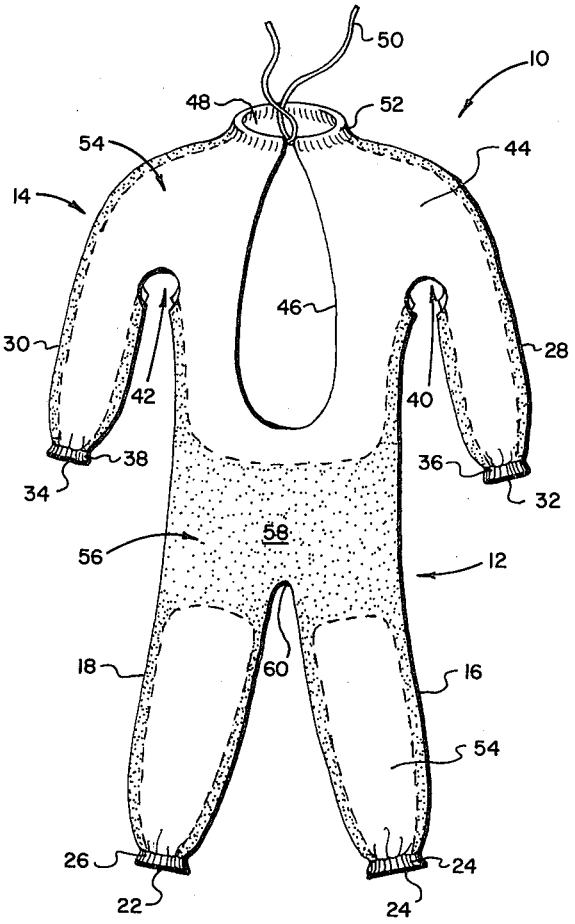
FIG. 2 is a rear elevation view of the coverall garment shown in FIG. 1.
Figure 3:
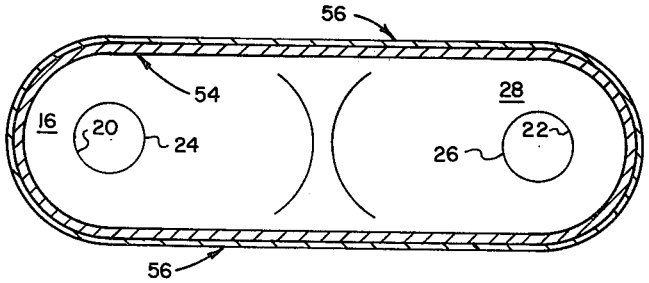
FIG. 3 is a sectional view, taken along the lines III—III of FIG. 1; and, FIG. 4 is a sectional view taken along the lines IV—IV of FIG. 3.
Figure 4:
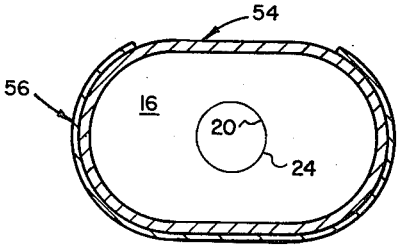

Referring now to FIGS. 1 and 2, a coverall garment 10 suitable for wear by a toddler during mealtime is illustrated. The coverall garment 10 is a one-piece clothing accessory having a lower trousers section 12 integrally formed along a common waistline with a blouse section 14. The trousers section is provided with separate leg coverings 16, 18 which are terminated by ankle openings 20, 22, respectively. The ankle openings are gathered slightly and are preferably reinforced by elastic webs 24, 26, respectively.

The blouse is provided with full length sleeves 28, 30 each having a wrist opening 32, 34, respectively. The wrist openings are gathered slightly and are reinforced by elastic webs 36, 38, respectively.

Ventilation openings 40, 42 are formed on the underside of each sleeve, and the back side 44 of the blouse is provided with a deep, cut-out opening 46 and a relatively smaller, oval neck opening 48.

As can best be seen in FIG. 2, the material forming the boundary of the large cut-out opening 44 and the material forming the boundary of the neck opening 48 are joined together along a common border by a drawstring 50 which is received within a fold 52. When the drawstring is tied, as illustrated in FIG. 2, the large cut-out opening has the appearance of a teardrop in outline, and provides a large ventilation opening. When the drawstring 50 is released, the material forming the back 44 of the blouse can be widely separated, wherein the cut-out opening 46 is enlarged by the neck opening 48 to permit the coverall garment to be quickly and easily slipped onto or removed from a toddler.

According to an important feature of the invention, the coverall garment 10 comprises a foundation liner 54 of a lightweight disposable material such as cotton or paper, for example paper of the type typically used to make disposable linen. Bonded to selected areas of the foundation liner 54 is a relatively absorbent layer 56 of a material such as paper of the type typically used to make disposable diapers. As can best be seen in FIGS. 1 and 2, the absorbent layer 56 is applied across the entire front of the coverall garment, including the arms, shoulders, torso, waist and legs. In FIG. 2, the seat 58 and crotch 60 are covered by the absorbent layer 56 on the underside of the coverall garment 10. According to this arrangement, the absorbent layer 56 is applied to the foundation liner in those areas most likely to be exposed to spilled food or drink.

The material comprising the foundation liner 54 is preferably treated by applying a coating of polyurethane to make it moisture resistant, and additionally, the foundatin liner 54 and the outer absorbent layer 56 are both preferably treated with a fire retardant compound. It is desirable that the material comprising the foundation liner and outer layer are both relatively tear resistant, but need not be durable since the coverall garment is intended for one-time use only.

From the foregoing description of a preferred embodiment of the invention, those skilled in the art will appreciate that the coverall garment of the present invention provides a convenient clothing accessory for children, and which is especially useful for training of toddlers during mealtime. Although a preferred embodiment of the invention has been described in detail, it should be understood that various changes, substitutions and alterations can be made therein without departing from the spirit and scope of the invention as defined by the appended claim.

What is claimed is:

1. A disposable, one-piece coverall for use by toddlers during mealtime as an outer garment for shielding the toddler and its clothing, said coverall garment having a blouse section including sleeves and a trousers section including separate leg coverings, said blouse section having an oval neck opening contiguous with a deep back opening extending along the middle of the back of the blouse to the waist, and said blouse section having ventilation openings formed along the underside of each arm, and a fastener attached to the blouse forming a common border between the oval neck opening and the back opening when closed, and said fastener being releasable to permit the back opening to be enlarged by the neck opening, said one-piece covering comprising an inner lining of relatively tear resistant material and an outer layer of absorbent material secured to the inner layer along the entire front, shoulders, arms, legs and seat.

* * * * *